US007188504B2

(12) United States Patent
Latour

(10) Patent No.: US 7,188,504 B2
(45) Date of Patent: Mar. 13, 2007

(54) WIRE BENDING DEVICE

(75) Inventor: Yves Latour, Haraucourt (FR)

(73) Assignee: Ateliers de Constructions Mecaniques Latour et Fils, Bazielles (FR)

( * ) Notice: Subject to any disclaimer, the term of this patent is extended or adjusted under 35 U.S.C. 154(b) by 169 days.

(21) Appl. No.: 10/949,748

(22) Filed: Sep. 24, 2004

(65) Prior Publication Data

US 2005/0076694 A1 Apr. 14, 2005

Related U.S. Application Data

(63) Continuation-in-part of application No. 10/203,991, filed as application No. PCT/FR01/00498 on Feb. 21, 2001.

(30) Foreign Application Priority Data

Feb. 21, 2000 (FR) ..... 00 02086

(51) Int. Cl.
*B21D 7/024* (2006.01)

(52) U.S. Cl. ..... 72/307; 72/217

(58) Field of Classification Search ..... 72/217, 72/216, 388, 387, 307
See application file for complete search history.

(56) References Cited

U.S. PATENT DOCUMENTS 3,299,681 A * 1/1967 Hautau ..... 72/14.8
3,680,347 A 8/1972 Schenck et al.
3,742,749 A 7/1973 Bondarenko et al.
3,894,422 A 7/1975 Peddinghuas
4,571,974 A 2/1986 Pollhammer et al.
5,373,719 A * 12/1994 Foerster ..... 72/157

FOREIGN PATENT DOCUMENTS

| | | |
|---|---|---|
| DE | 0 936 005 | 12/1985 |
| EP | 34 21 338 | 8/1999 |
| FR | 2 744 941 | 8/1997 |

* cited by examiner

*Primary Examiner*—Daniel C. Crane
(74) *Attorney, Agent, or Firm*—Egbert Law Offices

(57) ABSTRACT

A wire bending device includes a bending head bearing two bending tools between which the wire to be bent is passed. Either tool is alternately capable of being fixed or being a pivot for rotation of the bending head therearound. The device also includes a mechanical device for feeding the wire axially in one direction or another; a mechanical device for rotatably driving the bending tools, in two different directions, about an axis of either bending tool; and a mechanical device for shifting the bending tools in a plane perpendicular to the axis about which the bending tools can rotate. There can be calculating controller for managing simultaneously the operation of the mechanical devices, so that the movements generated by the wire and bending tools are superposed.

2 Claims, 3 Drawing Sheets

WIRE BENDING DEVICE

RELATED U.S. APPLICATIONS

The present application is a continuation-in-part of U.S. patent application Ser. No. 10/203,991 filed on Aug. 15, 2002, and entitled "WIRE BENDING DEVICE", now abandoned.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to a wire bending device.

BACKGROUND OF THE INVENTION

There are presently two large categories of wire bending machines: those used for large series that comprise bending tools placed in a position corresponding to the profile to be imparted to the metal wire; and those used for small series that permit passing from one profile to another, without it being necessary to change tools, in contrast to the preceding large series machines.

All the machines of this second category make use of the same bending method, consisting of passing the wire between two bending tools, one tool being fixed in place and the other tool being mobile. The other tool is rotatable concentrically around the fixed tool as a pivot point.

Practically, the wire coming from a reel or a coil passes through a straightener, then the wire engages a feeding system, that sends a desired length of wire to a bending head. The bending head is generally mobile and rotatable around the longitudinal axis of the wire. There is a fixed catch for anchoring the wire and a bending roller for bending the wire by rotating concentrically about the fixed catch.

Changing of the curving direction is achieved by changing the starting position of the catch and the roller, because the positions of the catch and roller are reversible with respect to the wire. The change of position is carried out by an axial rotation around the wire or by a longitudinal displacement of the wire after retraction into or away from the bending head when rotation is not possible.

These numerous control machines are very flexible in use, and permit producing series of pieces ranging from several dozens to several thousands.

Victims of their success, they are used for larger series, since, with experience, their programming becomes easy.

Nevertheless, for large series, one quickly finds out that they are slow, because of the retraction time for the roller and the catch, which represents about 40% of the overall time of a bending operation.

In order to cope with this drawback, it has been proposed, in particular in FR 2,744,941, to pass the wire to be bent between two rollers, each one capable of being driven in rotation concentrically around the other one, which is fixed in this case.

This method avoids the retraction periods of the bending roller, since both rollers can at will become alternatively bending roller or fixed catch for maintaining the wire.

In order to implement this method, there has been proposed in this document, a device comprised of a bending head mobile in rotation around the axis of the wire, and two parallel shafts passing the wire to be bent therebetween transversally and externally with respect to a bending head. the wire to be bent. The parallel shafts are connected through a part comprised of two identical gears integral with each other, not coaxially, by their flanks. Each of the parallel shafts cross one of the gears, axially and jointly. For each of the shafts, there is a guiding path in the shape of an arch of a circle, each guiding path being coaxial in relation to the other shaft. A gear driven in rotation in one direction or in the other, positioned in the region in front of the concave portions of said guiding paths, meshes with the remaining gear.

This device is relatively complex and has the drawback of being unreliable over the course of time.

This lack of reliability is increased in that the steering of the shafts in the guiding paths is made through sliding runners, that suffer from problems due to wear.

BRIEF SUMMARY OF THE INVENTION

This invention aims at coping with this drawback by providing a bending device operating according to the same method but with a more robust and therefore more reliable design.

The wire bending device of the present invention refers to a device comprising one bending head carrying two bending tools between which passes the wire to be bent, each tool being alternately capable of being driven in rotation concentrically around the other one and being fixed in position as a pivot. The present invention further comprises:

- a mechanical means capable of shifting the wire to be bent axially in one direction or another;
- a mechanical means capable of driving the bending tools in rotation, in both directions, around an axis parallel to that of the tools;
- a mechanical means capable of shifting, in both directions, the tools being in a plane perpendicular to the axis around which the latter can rotate; and
- a computation and control means capable of governing the simultaneous operation of the mechanical means, so as to obtain a superposition of the movements the latter generate.

The superposition of the movements generated by the various mechanical means permits carrying out, in a relative manner, the positioning and the immobilization of one of the tools in relation to the wire to be bent, while causing the other tool to rotate concentrically about the immobilized tool.

According to an additional feature of the device according to the invention, the axis around which the tools can rotate is arranged at the intersection of the axis of displacement of the wire to be bent and a line joining the axes of the tools.

According to another additional feature of the device according to the invention, the bending tools consist of rollers.

According to another additional feature of the device according to the invention, the mechanical means consist of stepping motors associated with transmission means.

According to a particular embodiment of the device according to the invention, the bending head is mounted in rotation on an arm, which is, in turn, mounted pivotally with respect to a feeding means for the wire to be bent.

BRIEF DESCRIPTION OF THE SEVERAL VIEWS OF THE DRAWINGS

The advantages and features of the device according to the invention will become more evident by the following description referring to the attached drawing, which represents a non-restrictive embodiment.

DETAILED DESCRIPTION OF THE INVENTION

Figure 1:
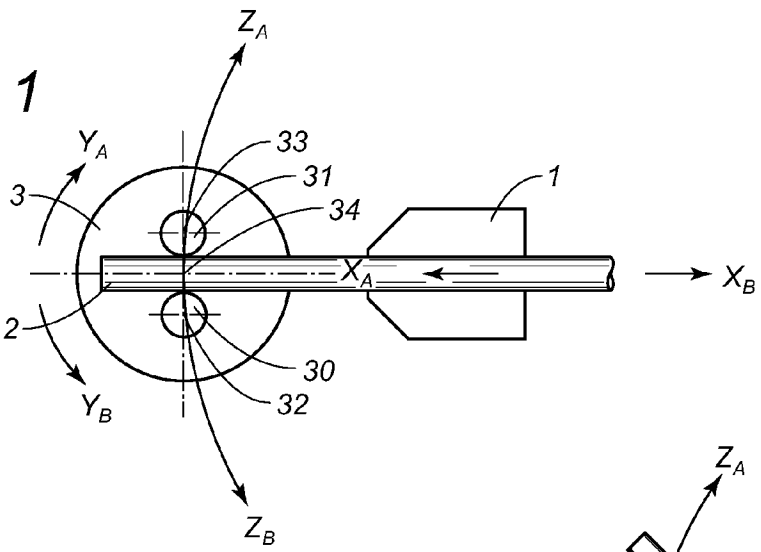
FIG. 1 is a partial schematic view of the bending head with two bending tools of the bending device according to the invention.

Referring to FIG. 1, one can see a partial schematic view of a bending device according to the invention, which comprises feeding means 1 for a wire 2 to be bent and a bending head 3.

The feeding means 1 is capable, through the action of the driving means, not shown, to pull the wire 2 axially, in the direction of the bending head 3, arrow $X_A$, or in the opposite direction, arrow $X_B$.

The bending head 3 comprises two bending tools, in this case two rollers 30 and 31, mounted and freely pivotable on the shafts 32 and 33, respectively. The wire 2 passes between the two bending tools 30 and 31 to be bent.

The bending head 3 is mobile in rotation around an axis 34, parallel to the shafts 32 and 33 and, in this particular embodiment, located in the middle of the segment that connects the latter, this rotation being able to be performed clockwise, arrow $Y_A$, or counterclockwise, arrow $Y_B$.

In addition, the bending head 3 is mobile in rotation with respect to the feeding means 1, so as to describe a path in the form of an arch of a circle, clockwise, arrow $Z_A$, or counterclockwise, arrow $Z_B$.

One should note that it is also possible for the displacement of the bending head 3 to be performed rectilinearly. This variant is advantageous from the point of view of the programming of the computation and control means, but its construction is more complex.

The different movements are carried out through the use of mechanical means, not shown in FIG. 1, such as for example stepping motors associated with transmission means, the operation of which is simultaneously governed by computation and control means permitting a superposition of these movements.

The superposition of these movements permits immobilizing the roller 30 or the roller 31 with respect to the wire 2 to be bent, while causing rotation around either immobilized roller 30 or 31, the roller, 31 or 30, respectively, which pulls and bends the wire 2.

The strict superposition of the movements according to $Y_A$, $Y_B$, $Z_A$ and $Z_B$, permits the rotation of one of the rollers around the other one that is positioned on the axis parallel to the wire 2 without remaining immobile. The immobilization is therefore achieved in a relative manner by the displacement of the wire 2 according to $X_A$ and $X_B$, which permits canceling the displacement of the rollers.

Figure 2B:
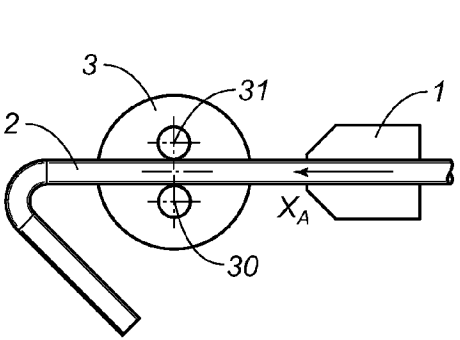
FIGS. 2*a,* 2*b,* and 2*c* are partial schematic views of the view shown in FIG. 1, during different sequential stages of a bending operation.
Figure 2C:
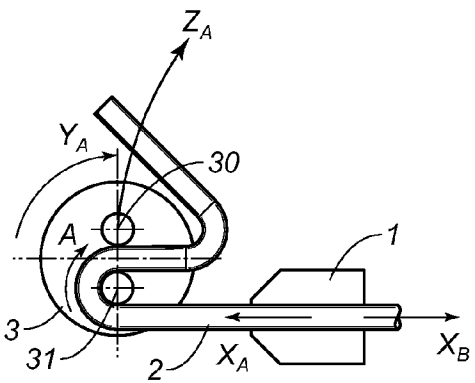
Figure 2A:
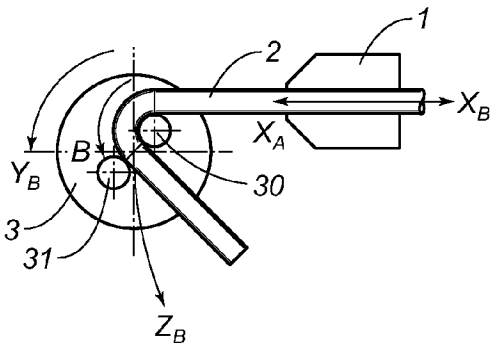

Referring to FIG. 2*a,* one can see that when bending the wire 2 in the counterclockwise direction, the roller 30 remains immobile, whereas the roller 31 rotates concentrically in relation to the roller 30 according to arrow B, in order to bend the wire 2.

The movement according to arrow B is achieved, commencing from a starting position such as the one shown in FIG. 1, by the superposition of a movement according to $Y_B$ and $Z_B$, as well as, successively, the movements according to $X_B$ and $X_A$.

The backward, then forward movement of the wire 2 according to $X_B$ and $X_A$ is required in that in the bending operation shown, the bending angle is larger than 90°.

In FIG. 2*b,* the bending head 3 is also placed in the starting position, whereas the wire 2 advances according to $X_A$ in order to perform another bending operation.

Referring now to FIG. 2*c,* one can see an operation of bending of the wire 2 in the clockwise direction, thus in a relative manner, the roller 31 remains immobile, whereas the roller 30 rotates concentrically in relation to the roller 31 according to arrow A, in order to bend the wire 2.

The movement according to arrow A is achieved by the superposition of a movement according to $Y_A$ and ZA, as well as, successively, the movements according to $X_B$ and $X_A$.

In the same way as for the bending operation shown in FIG. 2*a,* the forward and backward movement of the wire 2 according to $X_B$ and $X_A$ is required in that the bending angle is larger than 90°.

The bending device according to the invention permits carrying out the bending of the wire. Such a bending device uses tested mechanical means offering therefore a greater reliability.

Figure 3:
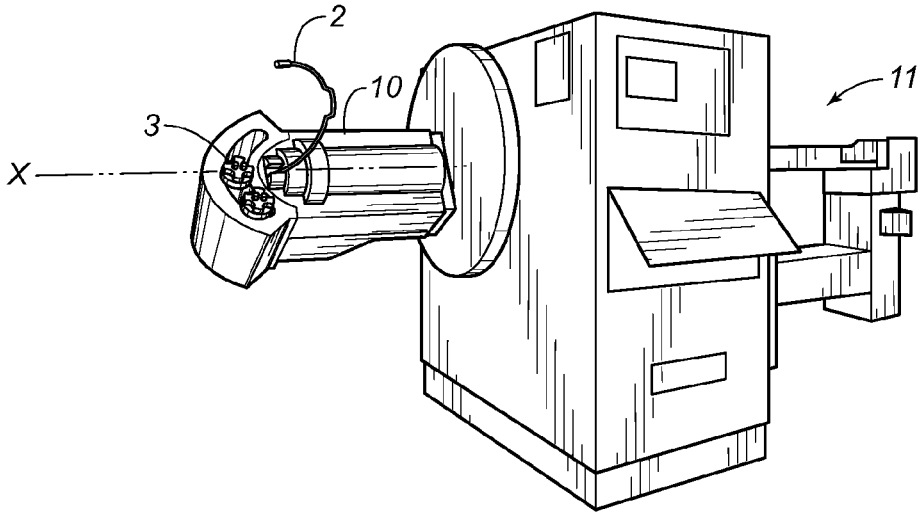
FIG. 3 is a perspective view of the bending device of the present invention, showing the bending head attached to the bending arm for shifting the bending head around the axis of the wire.

When referring to FIG. 3, one can see a wire-bending machine 11 which includes an arm 10, which is capable of axially rotating about an axis X, having longitudinal directions $X_A$ and $X_B$. FIG. 3 further illustrates the possible placement of stepper motors and computation and control means for the present invention.

Figure 4:
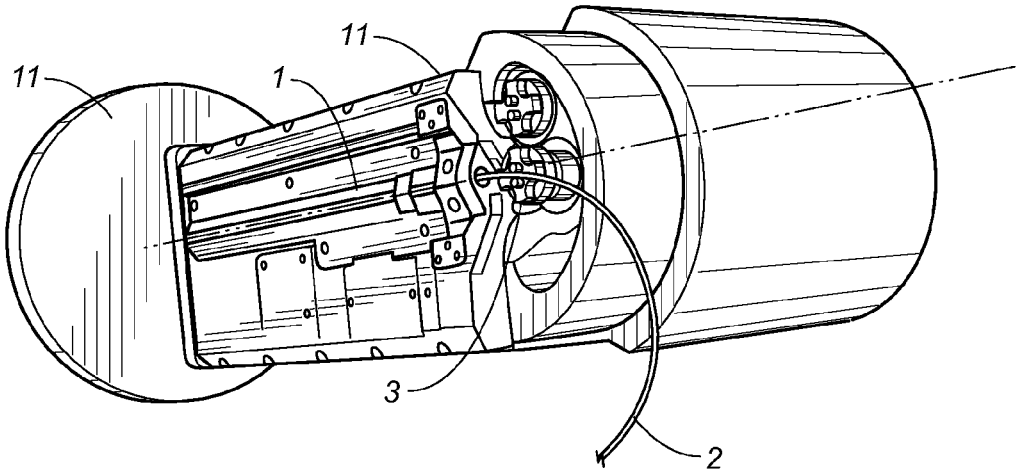
FIG. 4 is a partial perspective view of the bending device of the present invention, showing the bending arm.
Figure 5:
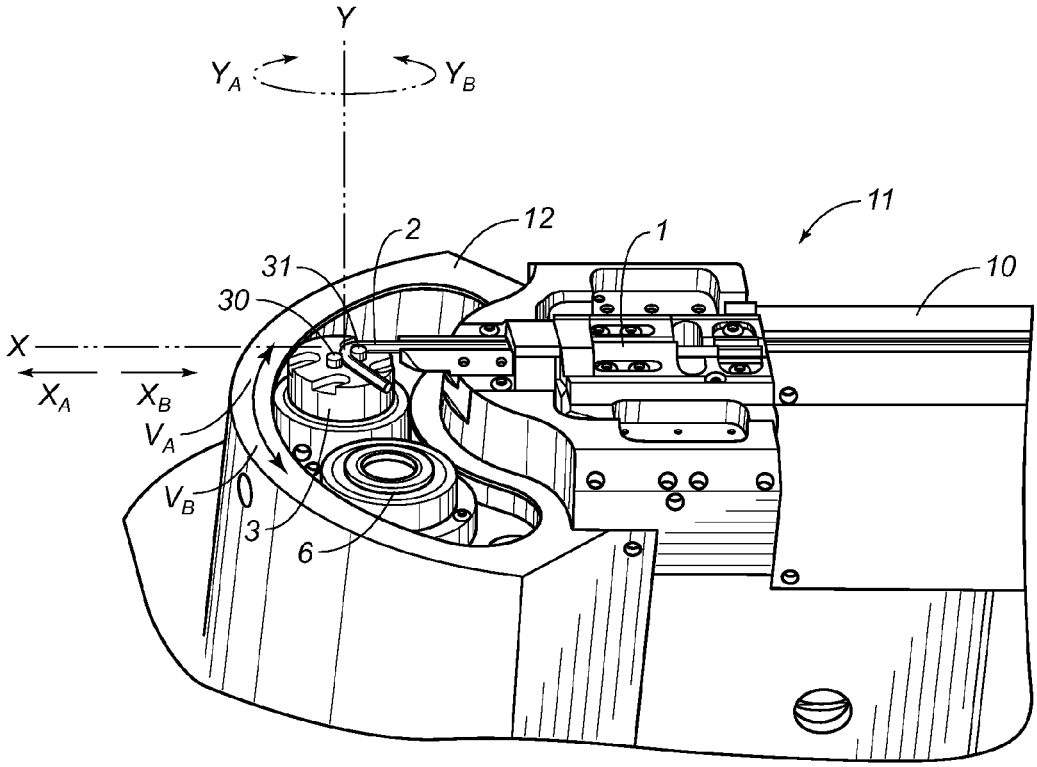
FIG. 5 is another isolated perspective view of an end of the bending arm with the bending head with bending tools.

As can also be seen in FIGS. 4 and 5, the arm 10 includes a groove that coincides with the axis X, and through which passes the wire 2, which move within the groove in the directions $X_A$ and $X_B$, under the action of feeding means 1 such as a gripper, which can also incorporate means for cutting the wire 2.

In FIG. 5, the arm 10 includes, at a free end thereof, a cage 12 in which are accommodated bending heads 3 and 6 with different functionalities. The bending heads 3 and 6 are movable in displacement, in order to place the necessary bending head 3 or 6 in front of the axis X of the wire 2, this displacement occurring in the direction $V_A$ or $V_B$.

Each of the bending heads 3 is movable in rotation about an axis Y perpendicular to the plane containing the axis X and in the directions $Y_A$ or $Y_B$ with a pivot point at 34 (shown in FIG. 1) so as to be capable of causing each of bending head to rotate in the directions $Y_A$ or $Y_B$.

The rotation of each of the bending heads in the directions $Y_A$ or $Y_B$ can occur autonomously, each one being then provided with a driving means.

Of course, one single driving means can be provided for, in which case the heads are connected to each other in rotation.

The bending head 3 shown in FIG. 5 is the one according to the invention in earlier FIGS. 1–2. The bending head 3 includes the two bending tools 30 and 31 as two fingers or rollers. The bending tools 30 and 31 each have an axis parallel to the axis Y.

The wire 2 is intended to pass between the bending tools 30 and 31, and the rotation of the bending head 3 bends the wire as the wire passes through the bending tools 30 and 31.

As shown in FIGS. 1 and 5, the bending head 3 can have only one Y axis of rotation, hence, in order to allow the bending in various directions, the Y axis of rotation is shifted between axes 32 (pivoted on bending tool 30), 33 (pivoted on bending tool 31) and 34 (pivoted between bending tools 30 and 31), by moving the bending head 3 in the directions along $Z_A$ and $Z_B$. The superposition of both motions thus allows the bending tools 30 or 31 to act as the axis of pivoting and, hence, of bending.

However, the superposition of these motions generates a displacement along the X axis of the feed of wire during bending. The displacement is corrected by controlling and superposing a displacement of a length of the wire 2 in either direction $X_A$ or $X_B$.

Furthermore, in a known way, the arm 10 is rotatable around the X axis, such that another bending is performed in another plane.

It should be noted, in addition, that the bending heads 3 and 6 are movable in axial translation of $V_A$ and $V_B$, in order to be capable of being retracted inside the cage 12 when they are not active, as is the case for the head 6 in FIG. 5, and for permitting the translation according to the directions $X_A$ after cutting the wire 2.

I claim:

1. A wire bending device comprising:

a bending head;

a first roller mounted on said bending head and selectively rotatable with respect to said bending head;

a second roller mounted in spaced relation to said first roller, said first and second rollers being selectively rotatable relative to said bending head, said bending head being rotatable so as to drive one of said first and second rollers in rotation about the other of said first and second rollers; and drive the other of said first and second rollers in rotation about the one of said first and second rollers a means for feeding wire along an axis of movement to said bending head in one direction or another between said first and second rollers, said means for feeding being mounted on an arm rotatable around said wire in a plane perpendicular to said wire, said arm being rotatable about said axis of movement of the wire in the means for feeding;

a means for rotating connected to said bending head, said means for rotating for driving said first and second rollers in rotation in one direction or another around an axis that is parallel to an axis of said first roller and an axis of said second roller, said means for rotating positioned at intersections of said axis of movement of the wire and a line extending between said axes of said first and second rollers; and a means for shifting said first roller and said second roller in a plane perpendicular to said axis of said means for rotating.

2. The wire bending device of claim 1, said means for rotating being a stepper motor.

* * * * *